United States Patent [19]

Robertson, Jr.

[11] Patent Number: 4,802,445

[45] Date of Patent: Feb. 7, 1989

[54] PARALLEL STAGED FLUIDIZED BED COMBUSTOR

[75] Inventor: Archibald S. Robertson, Jr., Whitehouse Station, N.J.

[73] Assignee: Foster Wheeler Development Corporation, Livingston, N.J.

[21] Appl. No.: 166,574

[22] Filed: May 12, 1988

[51] Int. Cl.[4] ..... B09B 3/00

[52] U.S. Cl. ..... 122/4 D; 48/61; 60/39.12; 110/229

[58] Field of Search ..... 122/4 D; 110/229; 60/39.12; 48/77, 101, 61

[56] References Cited

U.S. PATENT DOCUMENTS 3,986,348 10/1976 Switzer, Jr. .
4,212,160 7/1980 Blaskowski .
4,417,528 11/1983 Vining et al. ..... 110/229
4,627,367 12/1986 Butt ..... 110/229 X
4,665,864 5/1987 Seshamani et al. ..... 122/4 D
4,738,207 4/1988 Moss ..... 110/229 X

OTHER PUBLICATIONS

Fifth International Conference on Coal Research, Sep. 1–5, 1980, Dusseldorf, Germany, pp. 609–625.

*Primary Examiner*—Edward G. Favors
*Attorney, Agent, or Firm*—Marvin A. Naigur; Warren B. Kice

[57] ABSTRACT

A fluidized bed combustor including a combusting cell for generating flue gases and a gasifier cell for generating a low BTU combustible off-gas. The off-gas is discharged from the vessel and is combusted to raise the temperature of the flue gases before they are passed to a turbine.

3 Claims, 1 Drawing Sheet

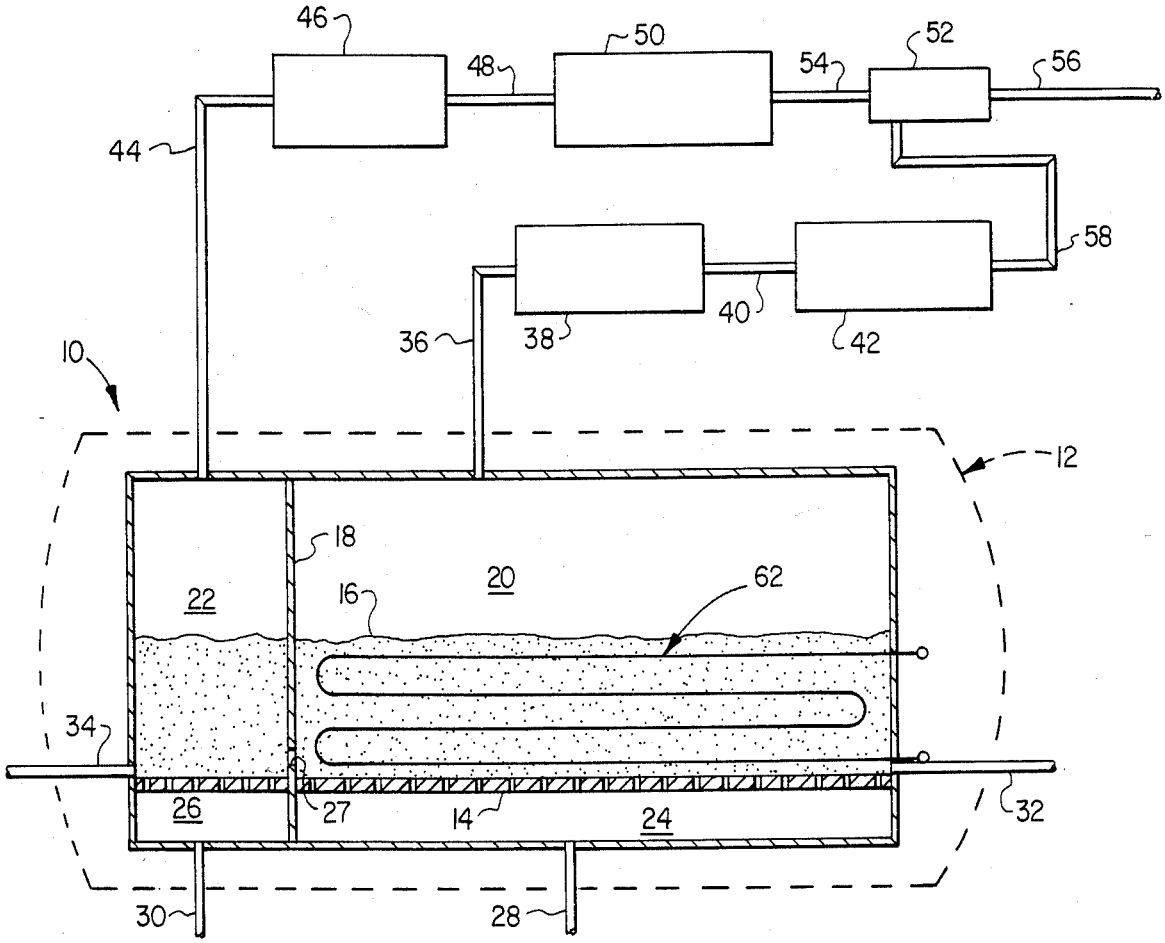
46
48
50
54
52
56
44
58
40
38
42
36
10
12
18
20
62
22
16
34
26
27
14
24
32
30
28

PARALLEL STAGED FLUIDIZED BED COMBUSTOR

BACKGROUND OF THE INVENTION

This invention relates to a fluidized bed combustor and, more particularly, to such a combustor having two parallel stages for generating gases to drive a turbine.

Combustion systems utilizing fluidized beds as the primary source of heat generation are well known. In these arrangements, air is passed through a bed of particulate material, including a fossil fuel such as coal and an adsorbent for the sulphur generated by the combustion of the coal, to fluidize the bed and promote the combustion of the fuel at relatively low temperatures. When the combustor is pressurized, the hot gases produced by the fluidized bed can be used to drive a turbine for the generation of electrical power.

One of the characteristics of a fluidized bed combustor is a relatively low gas temperature which is necessary in order to keep the pollutant emissions low. However, this results in a compromise in the combined boiler-turbine cycle efficiency since the turbine can be operated with gas temperatures well in excess of the maximum permitted in a fluidized bed boiler. Hence, in order to increase the temperature of the gas entering the turbine to improve the cycle efficiency, it has been proposed to gasify a slip stream of the fuel feed in a separate vessel. This fuel gas stream then combines with the flue gases from the boiler in a burner to raise the temperature of the latter gases to acceptable levels. However, this requirement of an additional gasifier considerably adds to the cost of the process and is thus undesirable.

SUMMARY OF THE INVENTION

It is therefore an object of the present invention to provide a method for generating gases for driving a turbine which eliminates the cost of a separate gasifier.

It is a further object of the present invention to provide a fluidized bed combustor which has a gasifier cell that generates a low BTU combustible off-gas which is burned in the presence of the flue gases from the combusting cell so that the latter attains an elevated temperature consistent with the optimum operation of the gas turbine.

Toward the fulfillment of these and other objects, according to the present invention a fluidized bed of particulate material including fuel is divided into a combusting cell and a gasifying cell. The fluidized bed in the gasifying cell is fluidized with a quantity of air that is insufficient for complete combustion of the fuel but sufficient to generate combustible off-gas. The off-gas and the flue gas are extracted from the gasifying cell and the combusting cell, respectively, and the entrained particulate material is separated from the gases before they are burned to raise their temperature before being passed to a turbine.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawing which is a schematic view of the combustor of the present invention.

DESCRIPTION OF THE PREFERRED EMBODIMENTS

Referring specifically to the drawings, the reference numeral 10 refers to a fluidized bed combustor including a vessel 12 having a perforated grate 14 extending for the length thereof for supporting a bed 16 of particulate material including fuel and a sorbent for absorbing the sulphur generated by the combustion of the fuel. A partition 18 extends vertically for the height of the vessel 12 and divides the vessel into a combusting cell 20 and a gasifying cell 22 extending above the grate 14 and into two air plenums 24 and 26 extending below the grate 14 and immediately below the cells 20 and 22, respectively. An opening 27 is provided in the lower portion of the partition just above the grate 14 for reasons that will be explained in detail later.

A pair of conduits 28 and 30 introduce air into the air plenums 24 and 26, respectively, and the air passes through grate 14 and is thus evenly distributed through the bed 16 in both of the cells 20 and 22 to fluidize the material. The quantity of air admitted to the cell 20 is controlled so that it is sufficient for complete combustion of the fuel in the bed 16, while the quantity of the air admitted to the cell 22 is controlled so that it is insufficient for complete combustion of the fuel but sufficient to generate a combustible, low BTU, off-gas. This air control is achieved by utilizing dampers, or the like (not shown), in the conduits 28 and 30 in a conventional manner.

A pair of feeders 32 and 34, or the like, are provided at each end of the vessel 12 to introduce additional fuel and adsorbent material into the bed 16 as needed. It is understood that one or more extraction units (not shown) may be provided in the bed so that solid products do not accumulate in the bed.

The gaseous products of combustion in the cell 20 combine with the air introduced via the conduit 28 to form a flue gas that passes through the height of the vessel 10 before exiting from an outlet conduit 36 which is connected to the inlet of a cyclone separator 38. A conduit 40 connects the outlet of the separator 38 to the inlet of a final filtration and/or alkali scavenger unit 42.

The low BTU off-gas generated in the cell 22 is passed, via a conduit 44, to a separator 46, and, from the outlet of the separator, to the inlet of a final filtration and/or alkali scavenger unit 50, via a conduit 48.

A burner 52 is connected, via conduits 54 and 58, to the respective outlets of the units 50 and 42, and a conduit 56 connects the outlet of the burner to a gas turbine (not shown). The burner 52 functions in a conventional manner to ignite the clean gases from the units 42 and 50 in the presence of the excess air from the unit 42, therefore producing a hot product gas which is fed, via the conduit 56, to the gas turbine.

A heat exchanger 62, consisting of a plurality of tubes, is disposed in the bed 16 in the cell 20 for removing heat from the cell by circulating water through the tubes in a conventional manner.

In operation, air from an extended source is passed, via the conduits 28 and 30, into the fluidized bed 16 in the cells 20 and 22 at a velocity sufficient to fluidize the bed and promote the combustion of the particulate fuel material in both cells. The air introduced into the cell 20, via the conduit 28, is in quantities sufficient to completely combust the fuel and form a flue gas that passes through the height of the vessel 12 before existing into the conduit 36. During this passage, the flue gas entrains the relatively fine particulate material in the bed before passing, via the conduct 36, into the separator 38.

The air introduced into cell 22 through the conduit 30 is carefully controlled so that it is insufficient to completely combust the fuel in the latter cell but sufficient to generate a combustible off-gas. The off-gas from the cell 20 exits from the vessel 12, via the conduit 44, and passes into the separator 46.

The gases in the separators 38 and 46 are separated from their entrained particulate material and the relatively clean gases from the separators pass, via the conduits 40 and 48, into the units 42 and 50, respectively, for further clean-up. The relatively pure gases from the units 42 and 50 pass, via the conduits 58 and 54, respectively, into the burner 52. At the burner 52 combustion of the combustible off-gas is achieved in the presence of the excess air from the unit 42 to raise the temperature of the gases before they pass, via the conduit 56, into the gas turbine. The spent material in the cell 22 is transferred to cell 20 via the opening 27 in the partition 18 before being discharged from the latter cell to external equipment.

It is understood that the solid particulate separated from the gases in the separators 38 and 46 can be reinjected back into cell 20 or 22 if needed.

It is understood that the fluidized bed 16 can be of a "bubbling" type or a "fast" type. In the bubbling type a bed of particulate materials is supported by an air distribution plate, to which combustion-supporting air is introduced through a plurality of perforations in the plate, causing the material to expand and take on a suspended, or fluidized, state. The gas velocity is typically two to three times that needed to develop a pressure drop which will support the bed weight (e.g., minimum fluidization velocity), causing the formation of bubbles that rise up through the bed and give it the appearance of a boiling liquid. The bed exhibits a well-defined upper surface. When provided with high solids recycle, the bubbling bed can build up its fines content and operate as a circulating fluidized bed.

In a "fast" fluidized bed the mean gas velocity, as a fraction of the minimum fluidizing velocity, is increased above that for the bubbling bed, so that the bed surface becomes more diffused and the solids entrainment from the bed is increased. According to this process, fluidized bed densities between 5 and 20% volume of solids are attained which is well below the 30% volume of solids typical of the bubbling fluidized bed. The formation of the low density fast fluidized bed is due to its small particle size and to a high solids throughout, which require high solids recycle. The velocity range of a fast fluidized bed is between the solids terminal, or free fall, velocity and a velocity beyond which the bed would be converted into a pneumatic transport line.

The high solids circulation required by any circulating fluidized bed makes it insensitive to fuel heat release patterns, thus minimizing the variation of the temperature within the steam generator, and therefore decreasing the nitrogen oxides formation. Also, the high solids loading improves the efficiency of the mechanical device used to separate the gas from the solids for solids recycle. The resulting increase in sulphur adsorbent and fuel residence times reduces the adsorbent and fuel consumption.

Several advantages result from the combustor of the present invention. For example, a fluidized bed, with the inherent advantages discussed above is utilized and is operated at the optimum temperature of 1600° F. while eliminating the need for utilizing a gasifier disposed in a separate vessel to raise the temperature of the gases to the requisite temperature required by the turbine. This is achieved by generating a combustible off-gas in the cell 22 and utilizing this gas to raise the temperature of the flue gases existing from cell 20. Thus, a relatively efficient operation is achieved.

It is understood that variations may be made in the foregoing without departing from the scope of the invention. For example, other techniques, such as nonmechanical valves, lift lines, etc. can be utilized to transfer the spent material in the cell 22 to the cell 20.

Other variations are intended in the foregoing disclosure and, in some instances, some features of the invention can be employed without a corresponding use of other features. Accordingly, it is appropriate that the appended claims be construed broadly and in a manner consistent with the scope of the invention therein.

What is claimed is:

1. A combustor comprising a vessel, means for dividing said vessel into two cells, means for passing air through a bed of particulate material including fuel disposed in each of said cells at a velocity sufficient to fluidize said particulate material and promote the combustion of said fuel, means for controlling the quantity of air introduced to one of said cells so that it is sufficient for complete combustion of the fuel in said latter cell to form a flue gas, means for controlling the quantity of air introduced to the other cell so that it is insufficient for complete combustion of said fuel but sufficient to generate a combustible off-gas, the flue gases from said combustion passing through said vessel and entraining a portion of said particulate material, outlets associated with said vessel for discharging said flue gas and said off-gas respectively, separating means respectively connected to said outlets for separating the entrained particulate material from said flue gases and from said off-gas, and means connected to said separators for burning said separated off-gas in the presence of said separated flue gases to raise their temperature.

2. The combustor of claim 1 wherein said burning means comprises a burner, and further comprising means for connecting said separating means to said burner.

3. The combustor of claim 1 further comprising heat exchange means disposed in at least one of said cells.

* * * * *